US005237490A

United States Patent [19]

Ferng

[11] Patent Number: 5,237,490

[45] Date of Patent: Aug. 17, 1993

[54] SOLAR POWER-OPERATED, CONSTRUCTION WORK WARNING LAMP WITH FOCUSING DEVICE FOR INTENSIFYING THE INTENSITY OF LIGHT

[76] Inventor: Shing-Lai Ferng, 29, Her Lih Street, Taipeng, Taichung, Taiwan

[21] Appl. No.: 910,623

[22] Filed: Jul. 7, 1992

[51] Int. Cl.[5] ..... F21L 9/00

[52] U.S. Cl. ..... 362/183; 362/185; 362/240; 362/338; 136/291

[58] Field of Search ..... 136/291; 340/908, 908.1; 362/183, 184, 185, 240, 251, 338, 363, 378, 455

[56] References Cited

U.S. PATENT DOCUMENTS

| | | | |
|---|---|---|---|
| 3,102,727 | 9/1963 | Rice | 362/185 |
| 3,767,904 | 10/1973 | Cook | 362/184 |
| 4,200,904 | 4/1980 | Doan | 362/183 |
| 4,459,643 | 7/1984 | Mori | 362/338 |
| 4,718,185 | 1/1988 | Conlin et al. | 136/291 |

*Primary Examiner*—Ira S. Lazarus
*Assistant Examiner*—Alan B. Cariaso
*Attorney, Agent, or Firm*—Bucknam and Archer

[57] ABSTRACT

A solar power-operated, construction work warning lamp which is consisted of a base secured inside a lamp guard and covered by a top cover and a bottom cover to hold a solar cell assembly and a light emitting assembly, wherein a light intensifier is fastened to the base on the top and secured in place by a framed seat and an enclosing wall, to intensify the intensity of light given by the solar cell assembly. The light intensifier is consisted of two symmetrical condenser lens assemblies connected into a cylindrical shape covered around the light emitting assembly to hold a plurality of condenser lens for intensifying the intensity of light given by the light emitting elements on the light emitting assembly.

2 Claims, 2 Drawing Sheets

SOLAR POWER-OPERATED, CONSTRUCTION WORK WARNING LAMP WITH FOCUSING DEVICE FOR INTENSIFYING THE INTENSITY OF LIGHT

BACKGROUND AND SUMMARY OF THE INVENTION

The present invention relates to a solar power-energized, construction work warning lamp which improves the "Solar power-operated, construction work warning lamp" as filed under U.S. patent application Ser. No. 07/837,050, now U.S. Pat. No. 5,152,601.

In U.S. Pat. No. 5,152,601, the present inventor disclosed a solar power-operated construction work warning lamp which uses a solar cell assembly to collect the radiant energy of sunlight and convert it into electric power for charging a storage battery and driving light emitting elements to flash signals by means of the control of a control circuit and a power switch. This structure of a solar power-operated construction work warning lamp has been proved practical in use. However, the intensity of light provided by the light emitting elements may not strong enough in some cases. The present invention is to add a focusing device to the solar power-operated construction work warning lamp for intensifying the intensity of light produced by the light emitting elements.

DETAILED DESCRIPTION OF THE PREFERRED EMBODIMENT

Figure 1:
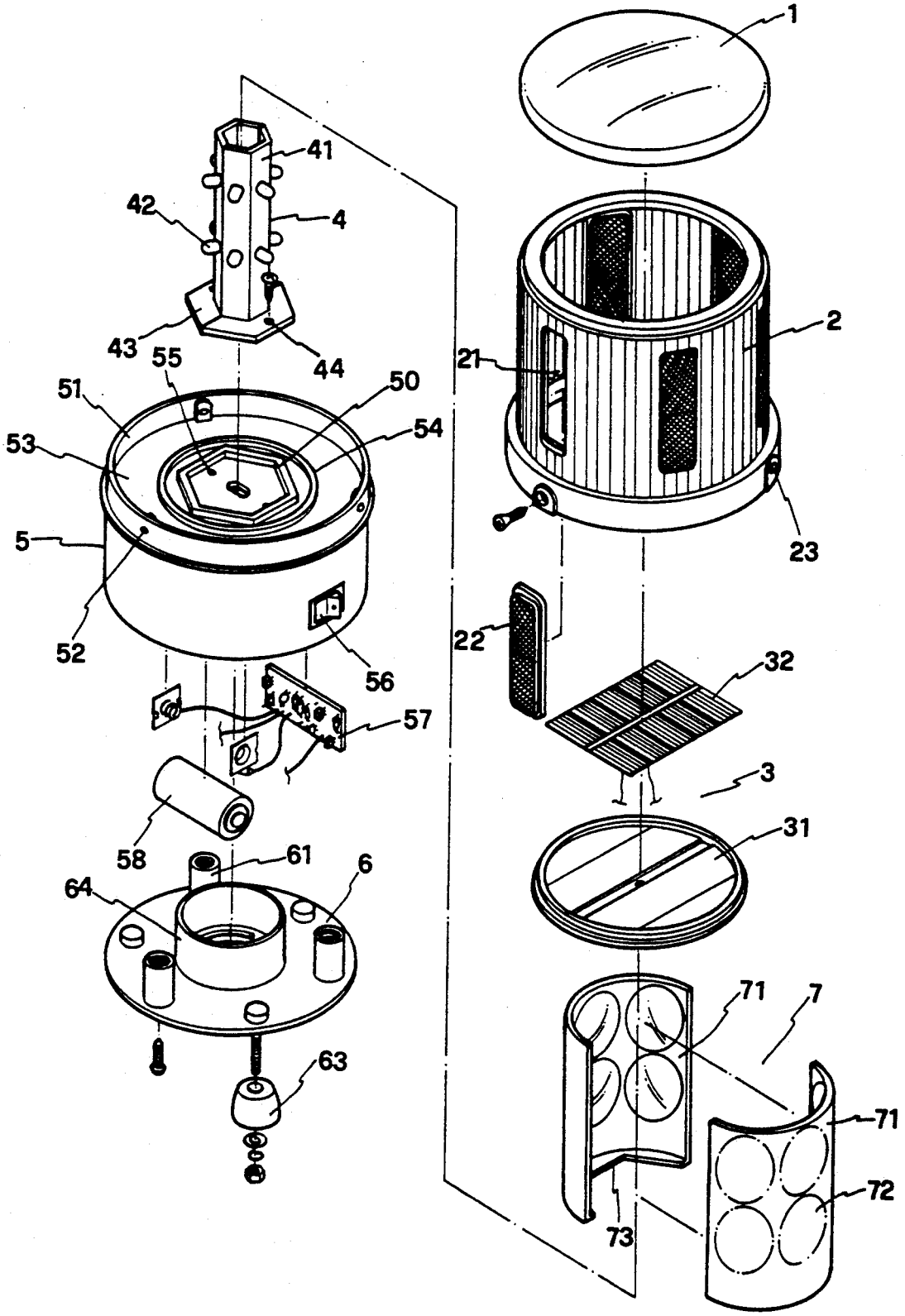
FIG. 1 is an exploded view of a solar power-operated construction work warning lamp embodying the present invention.
Figure 2:
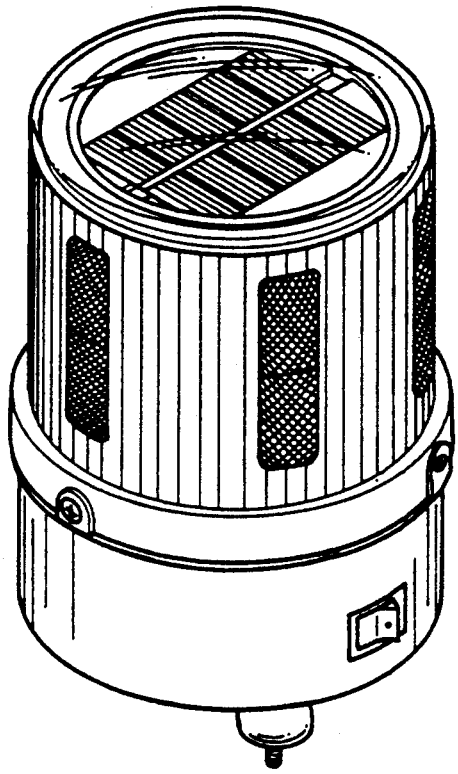
FIG. 2 is an elevational view of the solar power-operated construction work warning lamp.

Referring to FIGS. 1 and 2, a solar power-operated, construction work warning lamp as constructed in accordance with the present invention is generally comprised of a top cover 1, a lamp guard 2, a solar cell assembly 3, a column 4, a base 5, and bottom cover 6, and a light intensifier 7.

The top cover 1 is made from a transparent material having a top surface curved outwards. When covered over the lamp guard 2, the top cover 1 is sealed to the top edge of the lamp guard 2 in a water-tight manner through an adhesive joint.

The lamp guard 2 is made from a hollow transparent cylinder having a plurality of openings 21 equidistantly spaced around the peripheral wall thereof, a plurality of reflectors 22 respectively mounted on the openings 21, and a plurality of fastening holes 23 around the peripheral bottom edge thereof for fastening the base 5.

The solar cell assembly 3 is comprised of a base board 31 having a plurality of solar cells 32 attached to the top edge thereof for collecting the radiant energy of sunlight. The solar cells 32 are connected to an IC (integrated circuit) board 57 inside the base 5. By means of the operation of the IC board 57, the radiant energy of sunlight collected by the solar cells 32 is converted into electric power for charging a storage battery 58, which is also set inside the base 5. The storage battery 58 can be a nickel-cadmium battery which has the capability of storing electric power and can be controlled to discharge it.

The column 4 is made in the shape of a polygonal pipe having a plurality of light emitting elements 42 mounted on the side walls 41 thereof. Light emitting diodes (LEDs) may be used for the light emitting elements 42 so that electric power consumption can be minimized. The light emitting elements 42 are connected to the IC board 57 through an electric circuit. The column 4 has holes 44 around the bottom flange 43 thereof for fastening to the base 5.

The base 5 is made in a cylindrical shape having one end opened and an opposite end closed by a cover board 53. As illustrated, the base 5 has a top ring 51 fitted into the bottom opening (not shown) of the lamp guard 2, and a top cover board 53 inside the top ring 51. The top ring 51 of the base 5 has a plurality of holes 52 around the peripheral wall thereof respectively secured to the fastening holes 23 on the lamp guard 2 by screws. The tope cover board 53 of the base 5 has a plurality of holes 55 respectively connected to the holes 44 on the bottom flange 43 of the column 4 by screws. The base 5 is attached with an On/Off switch 56 on the outside electrically connected to the storage battery 58, the IC board 57, the light emitting elements 42 and the solar cell assembly 3 forming into a circuit. The top cover 53 of the base 5 further comprises a framed seat 50 on the top edge thereof into which the bottom flange 43 fits, and an enclosing wall 54 around the framed seat 50.

The bottom cover 6 has a plurality of bolt sleeves 61 on the top edge thereof connected to respective bolt sleeves (not shown) on the cover board 53 of the base 5 by screws, a raised portions 64 on the top edge at the center to stop the storage battery 58 in place, and a support plurality of legs 63 on the bottom edge thereof for supporting on a lamp support or the ground in a construction work.

The light intensifier 7 is consisted of two symmetrical condenser lens assemblies 71 connected into a cylindrical shape covered around the column 4. The light intensifier 7 has a bottom flange 73 tightly fitted into the gap between the enclosing wall 54 and the framed seat 50. The condenser lens assemblies 71 have each a plurality of condenser lenses 72 at locations corresponding to the light emitting elements 42 on the column 4.

When in operation, the light emitting elements 42 emit light through the light intensifier 7 and the reflectors 22 on the lamp guard to give warning of danger to the moving objects at approach. While passing through the light intensifier 7, the intensity of light is intensified by the condenser lenses 72.

As indicated, the present invention is to add a light intensifier to a solar power-operated construction work warning lamp for intensifying the visual warning signals produced thereby. However, it is to be understood that the drawings are designed for purposes of illustration only, and are not intended as a definition of the limits and scope of the invention disclosed.

What is claimed is:

1. A solar power-operated construction work warning lamp comprising a base secured inside a lamp guard and covered by a top cover and a bottom cover to hold a solar cell assembly and a light emitting assembly, said solar cell assembly being able to collect the radiant energy of sunlight and convert it into electric power for turning on a plurality of light emitting elements on said light emitting assembly, wherein said base has a framed seat surrounded by an enclosing wall on a top edge thereof to hold said light emitting assembly, and a light intensifier fastened in a gap between said framed seat and said enclosing wall, said light intensifier comprising two symmetrical condenser lens assemblies connected into a cylindrical shape covered around said light emitting assembly, said condenser lens assemblies having each a plurality of condenser lenses at locations corresponding to the light emitting elements on said light emitting assembly for intensifying the intensity of light given by said light emitting elements.

2. The solar power-operated construction work warning lamp according to claim 1, wherein said bottom cover has a raised portion for holding a storage battery inside said base.

* * * * *